US009447535B2

(12) United States Patent
Grunert et al.

(10) Patent No.: US 9,447,535 B2
(45) Date of Patent: Sep. 20, 2016

(54) DIFFUSER FOR CLEANING A FLUFF-LADEN COMPONENT

(75) Inventors: Klaus Grunert, Berlin Reinickendorf (DE); Günter Steffens, Dallgow-Döberitz (DE)

(73) Assignee: BSH HAUSGERÄTE GMBH, Munich (DE)

( * ) Notice: Subject to any disclaimer, the term of this patent is extended or adjusted under 35 U.S.C. 154(b) by 846 days.

(21) Appl. No.: 13/809,928

(22) PCT Filed: Jul. 4, 2011

(86) PCT No.: PCT/EP2011/061170

§ 371 (c)(1),
(2), (4) Date: Jan. 14, 2013

(87) PCT Pub. No.: WO2012/007300

PCT Pub. Date: Jan. 19, 2012

(65) Prior Publication Data

US 2013/0104946 A1 May 2, 2013

(30) Foreign Application Priority Data

Jul. 16, 2010 (DE) ..... 10 2010 031 459

(51) Int. Cl.

*D06F 58/22* (2006.01)
*D06F 39/00* (2006.01)
*D06F 58/24* (2006.01)

(52) U.S. Cl.

CPC ..... *D06F 39/00* (2013.01); *D06F 58/22* (2013.01); *D06F 58/24* (2013.01)

(58) Field of Classification Search

CPC ..... D06F 58/22; D06F 58/24; D06F 58/20; D06F 58/206; D06F 25/00

USPC ..... 134/34, 42, 10, 104.2, 198, 18; 34/82, 34/85, 90, 83, 610, 130; 68/20, 13 R, 19.1, 68/3 R, 18 F

See application file for complete search history.

(56) References Cited

U.S. PATENT DOCUMENTS 8,182,612 B2 5/2012 Grunert
8,377,224 B2 * 2/2013 Grunert ..... D06F 58/22 134/34

(Continued)

FOREIGN PATENT DOCUMENTS

CN 1609326 A 4/2005
DE 3738031 A1 5/1989

(Continued)

OTHER PUBLICATIONS

International Search Report PCT/EP2011/061170 dated Dec. 15, 2011.

(Continued)

*Primary Examiner* — David Cormier
*Assistant Examiner* — Thomas Bucci
(74) *Attorney, Agent, or Firm* — Nixon & Vanderhye P.C.

(57) ABSTRACT

A cleaning diffuser is disposed above a fluff-laden component and receives rinsing fluid for distributing the rinsing fluid to the fluff-laden component to detach fluff and carry it away. The diffuser is constructed to enable a buildup of dynamic pressure in the rinsing fluid and has two feed ducts which extend at a distance from one another in substantially parallel relationship so that rinsing fluid entering the diffuser is divided between the feed ducts. The feed ducts terminate in pockets in a wall at an end of the diffuser and have, relative to their entire duct length, a narrow, three-dimensional transverse mutual connection in the form of a transverse chamber. The diffuser has at least one narrow outlet opening which extends from the three-dimensional transverse connection to a lower side of the diffuser for distributing the rinsing fluid to the fluff-laden component.

19 Claims, 3 Drawing Sheets

(56) References Cited

U.S. PATENT DOCUMENTS

| | | | |
|---|---|---|---|
| 2010/0154240 | A1 | 6/2010 | Grunert |
| 2010/0263692 | A1 | 10/2010 | Grunert |
| 2011/0167662 | A1 | 7/2011 | Dittmer et al. |

FOREIGN PATENT DOCUMENTS

| | | | | |
|---|---|---|---|---|
| DE | 102006018469 | A1 | 10/2007 | |
| DE | WO 2009077291 | A1 * | 6/2009 | ..... D06F 58/22 |
| DE | 102008041474 | A1 | 2/2010 | |
| EP | 1936022 | A1 | 6/2008 | |
| KR | 20090024589 | A | 3/2009 | |

OTHER PUBLICATIONS

National Search Report DE 10 2010 031 459.5 dated Mar. 2, 2011.

* cited by examiner

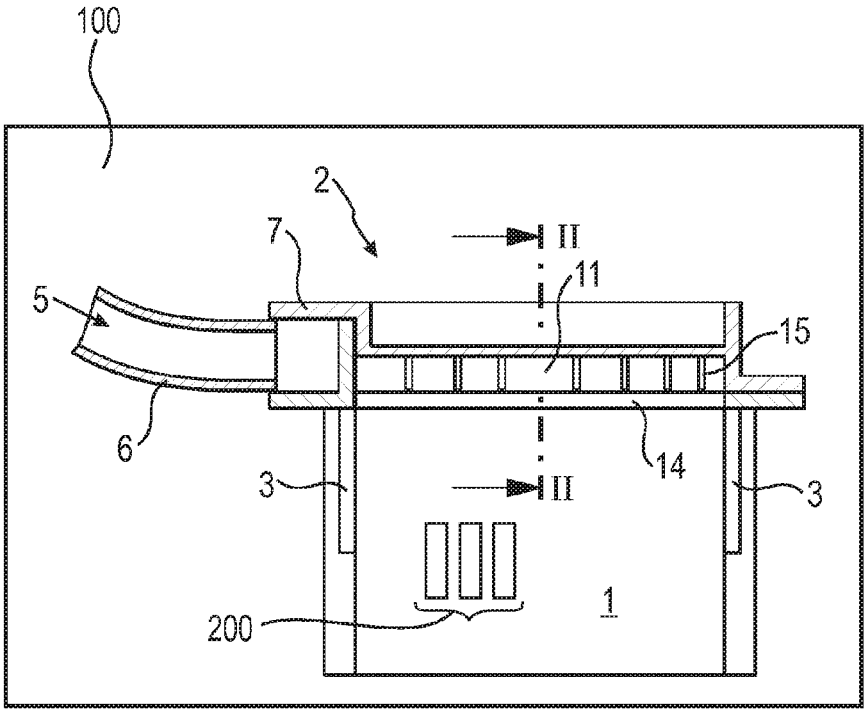
Fig. 1
Fig. 2
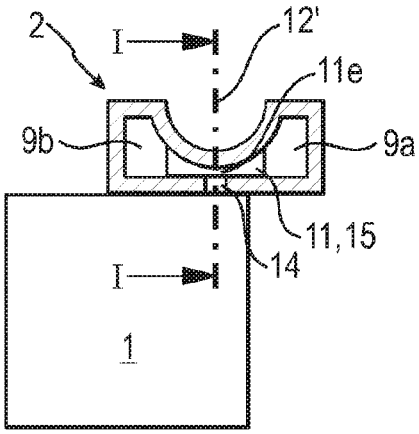
Fig. 3
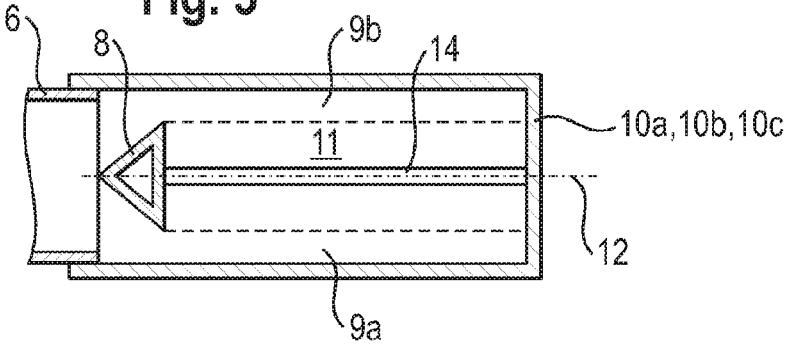

DIFFUSER FOR CLEANING A FLUFF-LADEN COMPONENT

CROSS-REFERENCES TO RELATED APPLICATIONS

This application is the U.S. national phase of International Application No. PCT/EP2011/061170, filed Jul. 4, 2011, which claims priority to DE Patent Application No. 10 2010 031 459.5 filed Jul. 16, 2010, the entire contents of each of which are hereby incorporated by reference.

BACKGROUND OF THE INVENTION

The invention relates to a cleaning diffuser for a fluff-laden component, in particular in a domestic appliance for caring for articles of laundry, the diffuser being a substantial component of a rinsing arrangement by means of which rinsing fluid can be fed to the component in order to remove the fluff, the diffuser being disposed above the component and in particular being suitable for distributing the rinsing fluid evenly over the blades of the component in order to detach the fluff and carry it away, it being possible for dynamic pressure to build in the rinsing fluid in the diffuser.

DE 10 2008 041 474 A1 discloses how a component within a process air channel of a domestic drying appliance can be cleaned by means of a rinsing system. The component is preferably an evaporator of a condensing arrangement. A fluff filter over which fluid flows is disposed in front of the evaporator. However, the blades of the evaporator and/or of the component itself are not directly rinsed. Rinsing processes are used in which a process air fan is installed at intervals in order that components behind the point for which targeted rinsing is provided can also be cleaned.

The cleaning device according to DE 10 2007 060 854 A1 for a fluff-laden component in a domestic appliance constitutes a very effective solution for enabling internal parts of the component such as blades to be cleaned, or rinsed, in a targeted way, whereby a flow element, hereafter also referred to as a diffuser, is disposed, or detachably mounted, above the component. The diffuser has a slit-like or slot-like opening, oriented toward the component, out of which the cleaning fluid can flow, and in particular in such a way that such cleaning fluid can flow out at a steady rate over the entire longitudinal extent of the slot-like opening, which is adapted to the dimension requirements of the component. This is only possible because the diffuser has an internal structure such as a cross-sectional constriction in order to generate dynamic pressure in the cleaning fluid. Although the diffuser according to DE 10 2007 060 854 A1 is outstandingly suited to achieving the desired cleaning effect for the fluff-laden component, which may be a heat exchanger, it should be regarded as less favorable that the known diffuser mounted on the component such as the heat exchanger or the evaporator of a heat pump in the process air channel of a domestic appliance such as a dryer, or washer-dryer, takes up too much room, particularly as regards its height dimension, that is to say in a direction extending parallel to the vertical direction of the domestic appliance in its operating position.

BRIEF SUMMARY OF THE INVENTION

One object of the invention therefore consists in disclosing a diffuser that can be disposed above a component belonging to a domestic appliance and, in particular, a diffuser that is low in height.

This object is achieved by a diffuser according to the independent claim. Preferred embodiments are disclosed in the dependent claims and in the description below, it then also being possible for several preferred embodiments to be combined within the scope of the invention, even if this is not explicitly specified.

Accordingly, the diffuser according to the invention is a cleaning diffuser for a fluff-laden component, in particular in a domestic appliance for caring for articles of laundry, the diffuser being a substantial component of a rinsing arrangement by means of which rinsing fluid can be fed to the component in order to remove the fluff, the diffuser being disposed above the component and in particular being suitable for distributing the rinsing fluid evenly over the blades of the component in order to detach the fluff and carry it away, it being possible for dynamic pressure to build up in the rinsing fluid in the diffuser, characterized in that the diffuser is designed such that, when the cleaning fluid has entered the diffuser, it is divided between two feed ducts which are at a distance from one another, are substantially parallel and terminate, on the one hand, in a barrier at the end of the diffuser, but which, on the other hand, relative to their entire duct length, have a narrow, three-dimensional transverse mutual connection, and in that at least one narrow outlet opening for distributing the rinsing fluid as required to the fluff-laden component is provided in the direction from the three-dimensional transverse connection to the lower side of the diffuser.

Preferably, at least one narrow outlet opening, e.g. 1-3 mm, preferably 2 mm, in width, is embodied in the base of the diffuser on a plane, or parting plane, intersecting the base of the diffuser, said outlet opening extending along the entire length, from the flow diverter to approximately the walls, which can, for example, comprise an intermediate wall that in addition is slightly offset and forms the end of the transverse chamber. In its standard embodiment, the outlet opening can be slot-like or slit-like. In the three-dimensional configuration of this diffuser, with cavities formed by very thin walls, the rinsing fluid that enters is initially distributed evenly along the length of the ducts. It can be assumed that a dynamic pressure that is favorable to such evening out builds up in the rinsing fluid. As the constriction provided in this embodiment in order to increase the dynamic pressure of the fluid is not obtained through a three-dimensional configuration that would adversely affect the height of the diffuser, but through a constriction in the transverse chamber which, in addition, is located above the slit-like outlet opening, the effect of this constriction on the height of the diffuser proves to be neutral. This results in a diffuser that is low in height. Also, on the basis of the law of fluid dynamics, it can be assumed that the speed of the issuing narrow elongated stream of liquid will be very advantageous as a result of the constriction above the slit-like outlet opening, leading to a very favorable cleaning result as regards fluff being carried away.

Provision is preferably made here for the transverse chamber to be designed in such a way in relation to the feed ducts that a dynamic pressure is generated in the rinsing fluid.

Therefore, with this embodiment of the invention, a dynamic pressure in the rinsing fluid is generated in a very different manner, in spatial terms, from the known prior art such as, for example, DE 10 2007 060 854 A1, in that merely through the division of the rinsing fluid between two feed ducts located directly above the base of the diffuser the desired dynamic pressure can be built up in the rinsing fluid. A three-dimensional arrangement in which the constriction required to build up the dynamic pressure requires a large proportion of the construction height for the flow element, or diffuser, above the component to be cleaned, is thus avoided in an impressive manner. The constriction known from the prior art is created by the transverse chamber, which preferably has a narrow cross section and which connects the two ducts transversely to their longitudinal extent and leads to at least one outlet opening, usually located centrally and with the same longitudinal extent as the ducts. This enables the formation of an elongated, even stream of water issuing at a suitably high speed.

Although it was initially claimed that two feed ducts are provided with this invention it is also intended that the invention include the possibility of providing a greater even number of feed ducts that would, in particular, contribute to the creation of a complex arrangement of diffusers that would be highly suitable for a component of larger dimensions in which there is little installation space above the component.

It is also possible to provide for the transverse chamber to have a constricted area in the region of the at least one outlet opening, thus making it possible to influence the dynamic pressure building up in the ducts in a particularly targeted fashion.

If the region of the transverse connection, or transverse chamber, is also subdivided by ribs transverse-mounted in relation to the feed ducts, a further favorable influence can be exerted on the embodiment of the elongated stream of water issuing from the at least one outlet opening.

The outlet opening need not be limited to a single, narrow longitudinal or slit-like opening: several slit-like outlet openings, or outlet openings with exit angles that are slanting in relation to a line running perpendicular to the base of the diffuser are also possible. The outlet openings can also each be embodied as a row of holes.

For the purposes of introducing a hose for feeding in the rinsing fluid it is advantageous for the diffuser to have a mouthpiece through which the rinsing fluid can enter. It has also proved to be favorable for the diffuser to have a flow diverter for dividing the rinsing fluid between the two feed ducts.

The manageability of the diffuser is particularly favorable if the diffuser is constructed of very few parts, with the parts described earlier that also form part of the invention and are shown separately, such as the mouthpiece, the flow diverter, the feed ducts, the transverse chamber and the like still being identifiable, but being connected to one another.

The embodiment consisting of few parts mentioned above may be manufactured by die casting, with investment casting or lost wax casting appearing to be particularly suitable methods.

For the purposes of mounting the diffuser on the component to be cleaned it is advantageous for the diffuser to be fitted with fastening clips on both sides, in particular on the outside of the feed ducts, the thickness of the fastening clips being adjusted to the wall thickness of the other parts or areas of the diffuser.

As far as use of the diffuser is concerned, a possible appliance having the blades to be cleaned is a heat exchanger, in particular an evaporator of a heat pump in, for example, the process air channel of a dryer, or washer-dryer.

BRIEF DESCRIPTION OF THE DRAWINGS

The invention is described in more detail schematically below, with the aid of exemplary embodiments. The same reference signs denote identical or similar parts. First follows a brief explanation of the figures:

FIG. 1 shows a schematic longitudinal section of a diffuser in relation to a heat exchanger;

FIG. 2 shows a schematic cross section of the diffuser, also in relation to the heat exchanger;

FIG. 3 is a diagram of a sectional plane above the base of the diffuser showing the division between two feed ducts of the entering cleaning fluid;

DETAILED DESCRIPTION OF EXEMPLARY EMBODIMENTS OF THE PRESENT INVENTION

Figure 4:
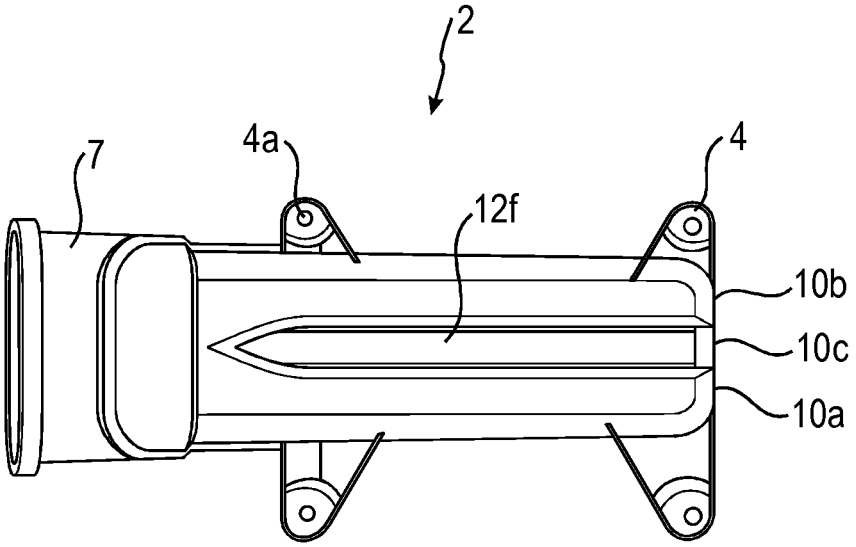
FIG. 4 is a plan view of a revised form of the diffuser.
Figure 5:
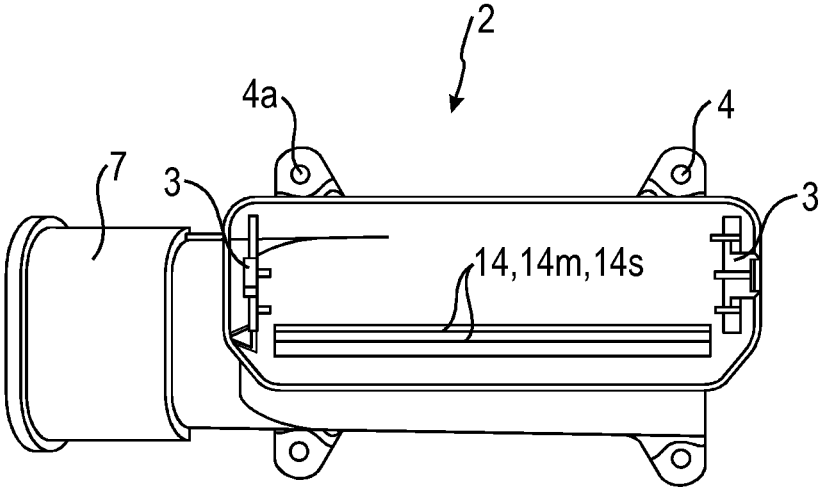
FIG. 5 is a view from below of a revised form of the diffuser.

A diffuser (given the reference sign 2 below) according to all the figures represents an essential rinsing device part with which rinsing fluid is directed to a component such as a heat exchanger 1, the inside of which is provided with blades 200 for the transfer of heat. In order to maintain the proper functioning of the domestic appliance 100 having the heat exchanger 1, such as a dryer, or washer-dryer, with a rinsing liquid 5 that is distributed as required when sprayed out, these blades must be freed of the fluff that is inevitably produced in the process air channel of the dryer. When mounted, the diffuser 2 according to the invention is located above the heat exchanger 1 and is provided with positioning elements 3 so that it is suitably oriented in relation to the heat exchanger 1. In FIG. 1 these positioning elements 3 are shown in side view. Also in FIG. 1, the diffuser 2 is shown in side elevation along the line of intersection I-I indicated in FIG. 2. In order that the diffuser 2 can be detachably fastened relative to the heat exchanger 1 the diffuser also has clips 4 with fastening holes 4*a*, which can only be seen in FIGS. 4 and 5.

A rinsing fluid 5, which can be either fresh water fed in from the network supplying the domestic appliance or condensate, is fed via a hose 6 to a mouthpiece 7 of the diffuser 2. A flow diverter 8, which distributes the rinsing fluid that is fed in between two feed ducts 9*a* and 9*b*, is located inside the mouthpiece 7 or at a small distance beyond the mouthpiece 7. The two feed ducts 9*a* and 9*b* terminate in pockets in the walls 10*a* and 10*b* opposite the mouthpiece 7. There is however a possibility that the rinsing fluid 5 fed in via the mouthpiece 7 and distributed between the feed ducts 9*a* and 9*b* will discharge, as the ducts 9*a* and 9*b* are connected to one another transverse to their axial orientation via a transverse chamber 11 that almost corresponds to the length of the ducts from the flow diverter 8, but which is significantly constricted approximately up to the line 12 midway between the ducts 9*a* and 9*b* or the line 12' running perpendicular thereto (corresponding to the line of intersection I-I). The transition area extending to the line 12 or to a shallow area 12*f* (see FIG. 4), can be curved in various different ways and can, for example, merge with the shallow area. The region of the transverse connection, or the transverse chamber, 11 can also be subdivided by ribs 15 that are transverse-mounted in relation to the feed ducts 9*a* and 9*b*. It is however important that on a plane, or parting plane, defined by the lines 12 and 12' and intersecting the base of the diffuser 2, at least one narrow outlet opening 14, for example, 1-3 mm, preferably 2 mm, in width, is embodied in the base 15 of the diffuser 2 and extends along the entire length, from the flow diverter 8 to approximately the walls 10*a* and 10*b*, which can, for example, comprise an intermediate wall 10*c* (see FIG. 4) that in addition is slightly offset and forms the end of the transverse chamber. In its standard embodiment, the outlet opening (14) can be slot-like or slit-like.

With the three-dimensional configuration adapted for the diffuser 2 described here, i.e. cavities formed by very thin walls, the rinsing fluid 5 entering through the mouthpiece 7 is initially distributed evenly along the length of the ducts 9*a* and 9*b*. It can be assumed that a dynamic pressure that is favorable to such evening out builds up in the rinsing fluid. As it would appear that the constriction provided in order to increase the dynamic pressure of the fluid is not obtained through a three-dimensional configuration that would adversely affect the height of the diffuser, but through a constriction in the transverse chamber 11 which, in addition, is located above the slit-like outlet opening 14, the effect of this constriction on the height of the construction proves to be neutral. This results in a diffuser that is low in height. Also, on the basis of the law of fluid dynamics, it can be assumed that the speed of the issuing narrow elongated stream of liquid will be very advantageous as a result of the constriction above the slit-like outlet opening 14, leading to a very favorable cleaning result as regards fluff being carried away from the blades of the diffuser 2.

In a further embodiment of the diffuser, rather than just a single slit-like outlet opening, several slit-like outlet openings 14*m*, which can also have exit angles 14*s* (see FIG. 5) that are slanting in relation to a line such as, for example, 12', are provided. The result can be a further improvement in the desired cleaning result.

The invention claimed is:

1. A cleaning diffuser for a fluff-laden component, said diffuser being disposed above the fluff-laden component and receiving rinsing fluid for distributing the rinsing fluid to the fluff-laden component to detach fluff and carry it away, said diffuser being constructed to enable a buildup of dynamic pressure in the rinsing fluid and having two feed ducts extending at a lateral distance from one another in substantially parallel relationship so that rinsing fluid entering the diffuser is divided between the feed ducts, said feed ducts terminating in pockets in a wall at an end of the diffuser and having, relative to their entire duct length, a narrow, three-dimensional transverse mutual connection in the form of a transverse passage, said diffuser having at least one narrow outlet opening extending from the three-dimensional transverse connection to a lower side of the diffuser for distributing the rinsing fluid to the fluff-laden component.

2. The diffuser of claim 1, constructed in the form of a domestic appliance for caring for articles of laundry.

3. The diffuser of claim 1, constructed to form part of a rinsing arrangement for supply of the rinsing fluid to remove the fluff.

4. The diffuser of claim 1, wherein the diffuser is constructed to evenly distribute the rinsing fluid over blades of the component.

5. The diffuser of claim 1, wherein the transverse chamber passage is designed in such a way in relation to the feed ducts that the dynamic pressure is generated in the rinsing fluid.

6. The diffuser of claim 1, wherein the transverse passage has a constricted area in a region of the at least one outlet opening.

7. The diffuser of claim 1, further comprising laterally extending ribs disposed in a region of the transverse connection and transverse-mounted in relation to the feed ducts.

8. The diffuser of claim 1, comprising a plurality of said outlet opening, each said outlet opening having a slit-like configuration.

9. The diffuser of claim 8, wherein each said outlet opening has a slanting exit angle.

10. The diffuser of claim 1, further comprising a mouthpiece for entry of the rinsing fluid, the mouthpiece having an opening to divert rinsing fluid parallel to the feed ducts.

11. The diffuser of claim 1, further comprising a flow diverter for dividing the rinsing fluid between the two feed ducts.

12. The diffuser of claim 1, constructed in the form of a die cast part.

13. The diffuser of claim 1, further comprising fastening clips fitted on both sides of the diffuser and having a thickness adjusted to a wall thickness of other parts or areas of the diffuser.

14. The diffuser of claim 1, wherein the fastening clips are arranged on an outside of the feed ducts.

15. The diffuser of claim 1, wherein the fluff-laden component is a heat exchanger equipped with blades.

16. The diffuser of claim 1, wherein a cross sectional area of each of the ducts is substantially equal.

17. The diffuser of claim 1, wherein the transverse passage, as seen in cross section, has a substantially flat bottom part adjacent the outlet, and a U-shaped top part.

18. The diffuser of claim 1, wherein the ducts, as seen in cross section, are symmetrically oriented relative to: (a) one another and (b) the opening.

19. The diffuser of claim 1, wherein lateral sides of the transverse passage are wholly contained within a space located between the ducts.

* * * * *